United States Patent [19]

Geffcken

[11] Patent Number: 4,625,148

[45] Date of Patent: Nov. 25, 1986

[54] GAS DISCHARGE DISPLAY DEVICE WITH AN AUXILIARY ANODE CONTROL PLATE

[75] Inventor: Walter Geffcken, Munich, Fed. Rep. of Germany

[73] Assignee: Siemens AG, Berlin and Munich, Fed. Rep. of Germany

[21] Appl. No.: 804,820

[22] Filed: Dec. 4, 1985

Related U.S. Application Data

[63] Continuation-in-part of Ser. No. 479,206, Mar. 28, 1983, abandoned.

[51] Int. Cl.[4] ..... H01J 17/49; H05B 41/14

[52] U.S. Cl. ..... 313/485; 313/585; 315/169.4

[58] Field of Search ..... 313/584, 585, 583, 493, 313/485; 315/169.4

[56] References Cited

U.S. PATENT DOCUMENTS

| | | | |
|---|---|---|---|
| 3,777,206 | 12/1973 | Armstrong | 313/584 |
| 4,047,077 | 9/1977 | Vieth | 313/585 |
| 4,130,778 | 12/1978 | Branston | 315/169.4 |
| 4,160,191 | 7/1979 | Hausfeld | 315/169.4 X |
| 4,328,444 | 4/1982 | Littwin | 315/169.4 X |
| 4,362,967 | 12/1982 | Littwin et al. | 313/493 |

*Primary Examiner*—Palmer C. DeMeo

*Attorney, Agent, or Firm*—Herbert L. Lerner; Laurence A. Greenberg

[57] ABSTRACT

A gas discharge display device having a gas-filled space defined on one side by a front plate and on a side opposite thereto by a back plate and subdivided by a control plate into a gas discharge space and a post-acceleration space, the control plate carrying electrode runs including column conductors and anode row conductors forming a matrix having cross-points defining image points, a fluorescent screen disposed on the side of the front plate facing the control plate and defining the post-acceleration space, the fluorescent screen having an anode layer thereon, and at least one insulated cathode on the side of the back plate facing the control plate and defining the gas discharge space, and an auxiliary control plate having anode conductor strips on at least one side thereof that are parallel with the anode row conductors, the device including groupings of anode row conductors, each group thereof having M sequentially numbered conductors; groupings of anode conductor strips, each group thereof having N sequentially numbered conductors, each of the anode row conductors being aligned with a corresponding one of the anode conductor strips forming an aligned conductor pair; conductor pair selecting means for selecting each aligned conductor pair which includes simultaneously applying a respective selection potential to each conductor of an aligned conductor pair.

8 Claims, 3 Drawing Figures

GAS DISCHARGE DISPLAY DEVICE WITH AN AUXILIARY ANODE CONTROL PLATE

CROSS-REFERENCE TO RELATED APPLICATION

This is a continuation-in-part of application Ser. No. 479,206, filed Mar. 28, 1983, now abandoned.

BACKGROUND OF THE INVENTION

1. Field of the Invention

The invention relates to a gas discharge display device having a space filled with gas, which is subdivided into a gas discharge space and a post-acceleration space by a control plate provided with electrode strips (column and anode row conductors) which form a matrix, a fluorescent screen on a front plate which bounds the post-acceleration space and is provided with an anode layer, one or more surface cathodes on the inside of a back plate which are insulated from each other and which bound the gas discharge space, and an auxiliary control plate, which is provided with anode conductor strips, on at least one side, which are aligned parallel with the anode row conductors.

2. Description of the Prior Art

It was well known, heretofore, that, in a gas discharge display device a reduction of the number of drive switching circuits is possible by combining the anode row conductors into groups combined with a subdivision of the cathode into cathode strips that are parallel with the anode row conductors and wherein each cathode strip corresponds with a group of anode row conductors.

The use of such combination of group selection, with a subdivision of the cathode into strips parallel to the anode row conductors does not completely ensure the flow of cathode current to only the desired anode row conductor. Rather, in most cases, a very small fraction of the current also reaches other anode row conductors in the same group as the selected anode row conductor. This results in the other anode row conductors also being weakly illuminated in addition to the selected anode row conductor. .

In copending application Ser. No. 470,702 filed Feb. 28, 1983, and now abandoned, of which I am a coinventor, the function of a row-wise constructed tetrode grid for reducing column crosstalk was described. Such a construction is realized by an auxiliary control plate with selectively one or two additional potential surfaces separated from one another, the auxiliary control plate being provided on at least one side thereof with anode conductor strip lines conducting the electric current and aligned parallel to the row conductors of the control plate, the strip lines having a passing or a blocking potential selectively applicable thereto for the electrons flying in direction towards a luminescent or fluorescent screen.

Gas discharge display devices of this general type are described in U.S. Pat. No. 4,130,778, DC PDP with Divided Cathode.

In a gas discharge display device (flat viewing screen) the plasma is advanced stepwise from one anode row conductor to the next anode row conductor. Just as many anode row conductor drive circuits are required as the number of anode row conductors that are present in the display device.

SUMMARY OF THE INVENTION

It is accordingly an object of the invention to provide a gas discharge device wherein the number of the required drive circuits is reduced.

With the foregoing and other objects in view, there is provided, in accordance with the invention a gas discharge display device having a gas-filled space defined on one side by a front plate and on a side opposite thereto by a back plate and subdivided by a control plate therebetween into a gas discharge space and a post-acceleration space, the control plate carrying electrode conductors including column conductors on one side and anode row conductors on the other side forming a matrix, forming crosspoints, each crosspoint defining an image point, and a fluorescent screen disposed on the side of the front plate facing the control plate and bounding the post-acceleration space, the fluorescent screen having an anode layer thereon, and the back plate having at least one insulated cathode on the side facing the control plate and bounding the gas discharge space, and further having an auxiliary control plate having anode conductor strips on at least one side thereof that are parallel with the anode row conductors, the latter which form a plurality of groups of anode row conductors and the former which form groups of anode conductor strips, a selected number of the plurality of groups of the anode row conductors being combined with a selected number of the plurality of groups of the anode conductor strips.

In accordance with an additional feature of the invention the number of the anode row conductors in a group thereof is odd, and the number of anode conductor strips thereby is even.

In accordance with an alternative feature of the invention the number of the anode row conductors in a group thereof is even, and the number of anode conductor strips in a group thereof is odd.

In accordance with another feature of the invention the product of the number of the anode row conductors in a respective group thereof with the number of the anode conductor strips in a respective group thereof is equal to the total number of the anode row conductors.

In accordance with a concomitant feature of the invention a selected number of groups of anode row conductors and a selected number of groups of anode conductor strips are combined to form the width of a larger group of anode row conductors called a super group.

Due to the combination of rhe grouping of anode row conductors on the control plate with a grouping of anode conductor strips of the auxiliary control plate, the luminescence of unselected anode rows can be suppressed. If the size of the groups (M lines in an anode row conductor group, N lines in an anode conductor strip group is selected so that M is odd and N is even (or conversely), then the distance between rows which are simultaneously selected to conduct current is equal to $N \times M$. If the total number of the anode rows in the viewing screen is as large, then no simultaneous unwanted parallel drive of two rows occurs. As a further advantage the number of the drive circuits for driving anode row conductors and anode conductor strips is reduced thereby from $M \times N$ to $M+N$.

Other features which are considered as characteristic for the invention are set forth in the appended claims.

Although the invention is illustrated and described herein as embodied in a gas discharge display device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
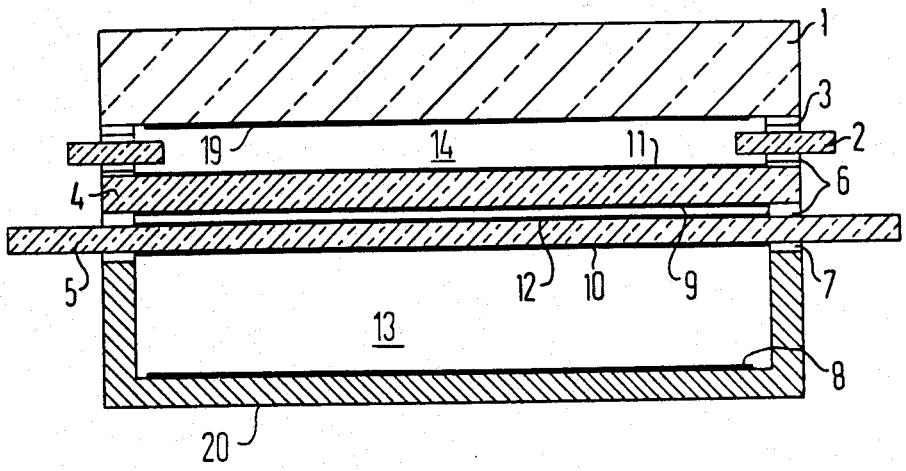
FIG. 1 is a diagrammatic cross-sectional view of a gas discharge display device according to the invention.

Referring now to the drawing and, first, particularly to FIG. 1 thereof, there is shown a gas discharge display device according to the invention, mainly formed of one or several cathodes 8 mounted on the inside of a back plate 20 and a control plate 5 which, on one side thereof which faces the cathodes is provided with anode row conductors 10 and, on the other side thereof, with vertical column conductors 12. The control plate 5 and the back plate 20 with the cathodes 8 are joined at the edges thereof by a glass soldering layer 7, and surround and define a gas discharge space 13 (plasma space). Between the control plate 5 and an anode layer with a luminescent (or fluorescent) screen 19 on the inside of a front plate 1, an auxiliary control plate 4 is disposed which, on the side thereof which faces towards the luminescent screen 19, there is provided a metallization or metal lining 11 for screening and, on the side thereof which faces away from the luminescent screen 1, there are provided a plurality of horizontal anode conductor strips 9. Between the auxiliary control plate 4 and the fluorescent screen 19, a spacing frame 2 is provided. The front plate 1, the spacing frame 2, the auxiliary control plate 4, and the control plate 5 are, in turn, joined by bonding at the edges of the gas discharge display device by means of glass solder layers 3 and 6. The post-acceleration space 14 is shown between the front plate 1 and the auxiliary control plate 4.

Figure 2:
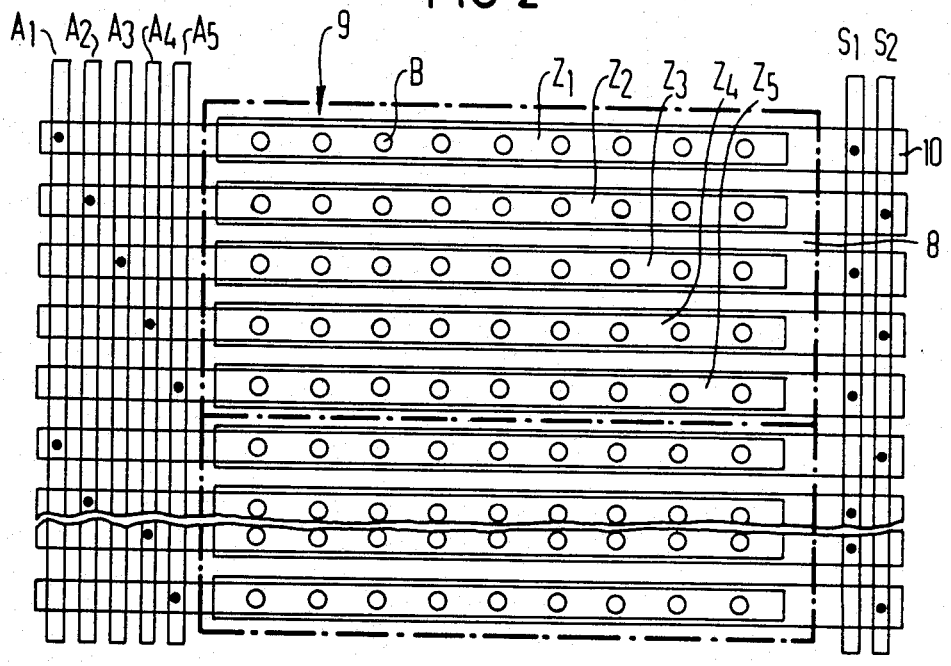
FIG. 2 is a diagrammatic elevational view of a grouping of anode row conductors and anode conductor strips forming part of the gas discharge display device.

FIG. 2 shows, as an example, inside stippled line boxes two groups each consisting of five anode row conductors 10, wherein the anode row conductors 10 in each group is designated Z1–Z5 and Z6–Z10, respectively. Each of the anode row conductors is connected with a control line in a group of control lines A1–A5. The connections between the anode row conductors and the control lines are indicated by the dots 15. Anode conductor strips 9 are aligned with corresponding anode row conductors forming aligned conductor pairs and are arranged, in this example, in groups of two each, and are controlled by anode conductor strip control lines S1, S2. The connection points between the anode conductor strips 9 and the corresponding control lines (S1, S2) are indicated by the dots 21. Image points B are formed at the cross-points between the column conductors 12 (FIG. 1) and the anode row conductors 10. Each image point B also includes a pair of aligned holes B (reference numerals 17, 18) with each hole formed respectively in the control plate 5 and the auxiliary control plate 4, for admitting electron beams from the cathode to the anode layer and the fluorescent screen 19. In principle, a division of the cathode 8 into several cathode strips is not required if the total number of anode row conductors is less than M times N, wherein M is equal to the number of anode row conductors in each group thereof and N is the number of anode conductor strips in each group thereof. In the instant exemplary embodiment, it follows that $M=5$ and $N=2$. The cathode current can be started with a start anode (not shown) at the beginning of each picture scan.

In the example embodiment of FIG. 2, the anode row conductor Z1 and the anode conductor strip 9 form an aligned conductor pair.

Figure 3:
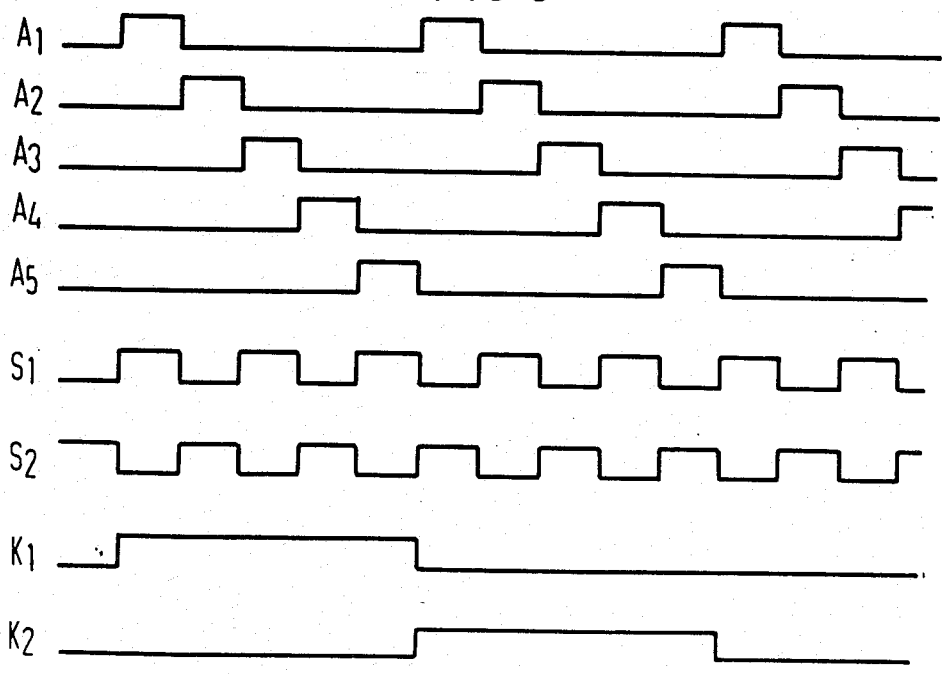
FIG. 3 is a pulse timing diagram showing the waveform of the control potentials applied to the anode row conductors and the anode conductor strips and the cathode strips.

FIG. 3 is a timing diagram showing the waveform of the control potentials. The timing diagram assumes that two cathode strips 8 (C1 and C2) are provided. The anode conductors 10 (Z1–Z5 and Z6–Z10) are driven in sequence with the pulses shown from a1–a5 applied to control lines A1–A5. The image scan begins with the firing of the cathode C1 indicated by potential K1, the current subsequently flowing row by row to the anode row conductors Z1–Z5. A very small part of the current flows to those of the remaining anode conductors 10 (Z6–Z10), which are similarly connected to control lines A1–A5, indicated by potentials a1–a5. Control lines S1 and S2 for the anode conductor strips 9 are energized in phase with the anode row conductors 10 so that the selected aligned conductor pair consisting of the correspondingly selected anode conductor strip 9 and the selected anode row conductor 10, respectively simultaneously selected by one of the potentials a1–a5 and one of the potentials s1–s2. In the example embodiment, the non-illustrated anode row conductors Z11–Z15 are similarly selected, whereas illustrated anode row conductors Z6–Z10 are blocked. The anode row conductors Z11–Z15 are then again connected for conduction. As soon as the first five anode row conductors 10 (e..g. conductors Z1–Z5) are traversed, the next cathode C2 switches on and anode row conductors Z6–Z10 are prepared for selection. It is apparent from this example that the distance or spacing between the anode row conductors is increased by a factor equal to the number of anode conductor strips 9 combined into one group, namely the factor two in the described example for a total group size of five times two, which equals ten, which is the so-called super group.

A larger picture or viewing screen having, for example, 378 anode row conductors 10 and twenty seven cathode conductor strips 8 could, for instance, be constructed with twenty seven (27) cathode strips 8, each corresponding to fourteen (14) super groups of anode row conductors, each consisting of row conductors 10 in groups of 7 combined with conductor strips 9 in groups of two.

In this case, the distance or spacing between simultaneously selected anode row conductors 10 will be two times seven which is equal to fourteen conductors. The total number of drive circuits would be two plus seven for the anode row conductors 10 and the anode conductor strips 9 respectively, which would equal nine plus twenty seven cathode drive circuits for a total of nine plus twenty seven, which equals 36 drive circuits instead of 378 drive circuits, which would be required without the invention.

I claim:

1. A gas discharge display device having a gas-filled space defined on one side by a front plate and on a side opposite thereto by a back plate and subdivided by a control plate into a gas discharge space and a post-acceleration space, the control plate carrying electrode runs including column conductors and anode row conductors forming a matrix having crosspoints defining image points, a fluorescent screen disposed on the side of the front plate facing the control plate and defining the post-acceleration space, the fluorescent screen having an anode layer thereon, and at least one insulated cathode on the side of the back plate facing the control plate and defining the gas discharge space, and an auxiliary control plate having anode conductor strips on at least one side thereof that are parallel with the anode row conductors, the device comprising groupings of anode row conductors, each group thereof having M sequentially numbered conductors; groupings of anode conductor strips, each group thereof having N sequentially numbered conductors, each of said anode row conductors being aligned with a corresponding one of said anode conductor strips forming an aligned conductor pair; conductor pair selecting means for selecting each aligned conductor pair which includes simultaneously applying a respective selection potential to each conductor of an aligned conductor pair.

2. Device according to claim 1 wherein said selecting means comprise a plurality of sequential anode row conductor selection potentials equal to M potentials and a plurality of sequential anode conductor strip selection potentials timed in phased relationship with the anode row conductor selection potentials, equal to N potentials; a plurality of anode row conductor control lines equal to M sequentially numbered control lines and a plurality of anode conductor strip control lines equal to N sequentially numbered control lines; said anode row conductor control lines commonly connected to all equally numbered anode row conductors and said anode conductor strip control lines connected commonly to all equally numbered anode conductor strips.

3. Device according to claim 2 wherein one of the numbers M and N is an even number and the other number is an odd number.

4. Device according to claim 3 comprising at least one supergroup of aligned conductor pairs, each super group including M times N aligned conductor pairs.

5. Device according to claim 4 comprising a plurality of anode row conductor groups and an equal plurality of cathode strips, each cathode strip aligned with a corresponding group of anode row conductors.

6. Device according to claim 1 wherein M is equal to five and N is equal to two.

7. Device according to claim 2 comprising a plurality of control line drive circuits equal to M+N.

8. Device according to claim 5 wherein said conductor pair selecting means comprise a plurality of sequential cathode selection potentials applied in sequence to the respective cathode strip aligned with the anode conductor group including a selected conductor pair.

* * * * *